United States Patent [19]

Ishizaki

[11] 3,958,307

[45] May 25, 1976

[54] BUTTON ASSEMBLY WITH ROTATABLE AND PIVOTABLE BUTTON

[76] Inventor: Hidenosuke Ishizaki, 6-13, 6-chome, Motoyamakita, Higashinada, Kobe, Japan

[22] Filed: Oct. 16, 1974

[21] Appl. No.: 515,199

[52] U.S. Cl. ..... 24/108; 24/217 R

[51] Int. Cl.[2] ..... A44B 1/38; A44B 17/00

[58] Field of Search ..... 24/108, 216, 217

[56] References Cited

UNITED STATES PATENTS

| | | | |
|---|---|---|---|
| 625,567 | 5/1899 | Kingston | 24/217 |
| 1,702,855 | 2/1929 | Swanson | 24/217 |
| 2,013,446 | 9/1935 | Reiter | 24/217 X |
| 2,151,284 | 3/1939 | Tinnerman | 24/217 |
| 3,235,297 | 2/1966 | Fernberg | 24/217 X |

FOREIGN PATENTS OR APPLICATIONS

| | | | |
|---|---|---|---|
| 546,133 | 6/1942 | United Kingdom | 24/217 |

*Primary Examiner*—Paul R. Gilliam
*Assistant Examiner*—Andrew M. Calvert
*Attorney, Agent, or Firm*—Larson, Taylor & Hinds

[57] ABSTRACT

Button leg comprising a support plate for a button main body, a leg main body having an upper constricted neck around which the support plate is loosely fitted in pivotably rotatably movable manner and a screw to be screwed into the leg main body to detachably fasten the button to a fabric without sewing the button thereto with yarn. When fixed to the support plate, the button can be engaged in and disengaged from the button hole easily and smoothly, while it is removable as desired for example during washing to avoid the damage to be caused to the button by detergent.

2 Claims, 6 Drawing Figures

BUTTON ASSEMBLY WITH ROTATABLE AND PIVOTABLE BUTTON

BACKGROUND OF THE INVENTION

The present invention relates to improvements in a button leg for fastening a button main body.

Generally the button is fastened to fabric with a thread in intimate contact therewith, so that it is difficult to cause the button to engage in and disengage from the button hole smoothly.

Among buttons for use with a thick fabric for example of an overcoat, there are some which have a leg of a predetermined length adapted to be fastened at its lower end to the fabric by sewing. With the button of this type, the button leg is secured to the main body of button. Thus the button main body itself is not movable pivotally or rotatably, and it is therefore difficult to assure smooth engagement and disengagement between the button and the button hole.

Furthermore in the case of buttons of either type described, the buttons are not removable from the fabric as desired unless the fastening thread is cut off, with the result that the following objections have been experienced conventionally. It is impossible to selectively replace the button easily as the wearer desires. When clothes are washed, the button will be lost accidentally due to break of the fastening thread. During laundering, the detergent damages the button, impairing its attractive appearance and lowering the ornamental effect of the button. Moreover buttons impede smooth ironing work.

SUMMARY OF THE INVENTION

An object of this invention is to provide a button leg on which the button main body can be mounted pivotally and rotatably so that the button is engageable in and disengageable from the button hole with ease and smoothly.

Another object of this invention is to provide a button leg for fastening a button main body which leg can be removably fastened to fabric with ease so that the whole button assembly can be removed from the fabric for example for washing or ironing to prevent the button from damage or to assure smooth ironing, the button therefore being replaceable selectively as the wearer desires.

The button leg of this invention for fastening a button main body comprises a support plate having an aperture at its center for supporting the button main body, a leg main body having a constricted neck at its upper portion around which the support plate is loosely fitted in pivotably rotatably movable manner and a screw-threaded bore formed coaxially with the leg main body and open at the bottom thereof, and a screw to be screwed into the bore of the leg main body to detachably fasten the leg main body to a fabric.

Since the button leg of this invention has the above construction to fasten the button main body, the support plate loosely fitted around the constricted neck of the leg main body is pivotably rotatably movable, with the result that the button main body fixed to the support plate is also pivotably rotatably movable. Thus the button can be engaged in and disengaged from the button hole smoothly and easily, permitting the wearer to put on and take off the clothes readily. By virtue of smooth engagement of the button in the button hole, the periphery of fabric defining the button hole is less liable to be damaged during engagement.

To secure the button leg to fabric, the bottom of the leg main body is placed on the front surface of the fabric, and the screw pierced through the fabric from the rear surface thereof is screwed into the bore of the leg main body. Accordingly the button can be fastened to the fabric with extreme ease without sewing with a thread. Furthermore since the button is readily removable, the button can be prevented from the damage to be caused by the detergent during washing. The objects of this invention are fulfilled reliably therefore.

For a better understanding of this invention, an embodiment will be described below in detail with reference to the accompanying drawings.

DESCRIPTION OF THE PREFERRED EMBODIMENT

Figure 1:
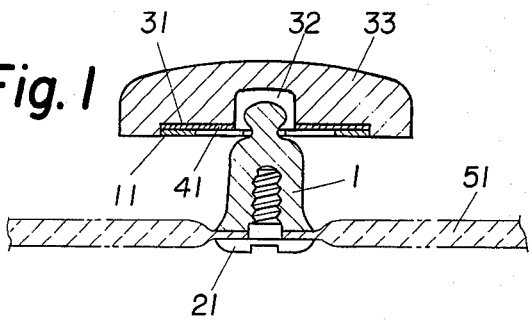
FIG. 1 is a view partly in vertical section showing a button leg of this invention as used to fasten a button main body to fabric.

The button leg of this invention for fastening a button main body comprises three metal members, i.e. a leg main body 1, a support plate 11 for the button main body and a screw 21.

The leg main body 1 includes at its upper portion a head 2, a constricted neck 3 having a smaller diameter than the head 2 and an enlarged shoulder portion 4 and has a screw-threaded bore 5 of a predetermined length formed coaxially with the body 1 and open at its bottom.

Figure 3:
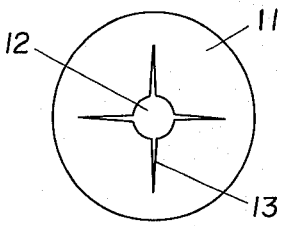
FIG. 3 is a plan view of a support plate for the button main body.
Figure 4:
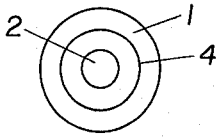
FIG. 4 is a plan view of the button leg.
Figure 2:
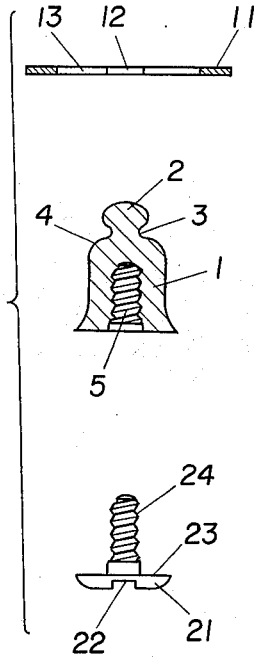
FIG. 2 is an exploded view partly in vertical section showing the button leg.
Figure 5:
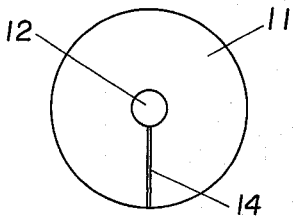
FIG. 5 is a plan view showing another example of the support plate for the button main body.

As shown in FIG. 3, the support plate 11 for the button main body is in the form of a planar thin disc and has a center aperture 12 having a diameter smaller than the diameters of the head 2 and shoulder portion 4 of the leg main body but larger than the diameter of the neck 3. Several cuts 13 extend radially from the periphery of the aperture 12, such that the aperture 12 can be enlarged by virtue of provision of the cuts 13. Alternatively the support plate 11 for the button main body may be formed with a single cut 14 which extends from the center aperture 12 to the outer periphery of the support plate as seen in FIG. 5. The cut 14 renders the aperture 12 enlargeable.

A screw 21 has a head 23 grooved as at 22 and a screw-threaded shank 24 extending from the center of the head 23.

The button leg of this invention having the foregoing construction for fastening the button main body is put to use in the manner illustrated in FIG. 1. First, the head 2 of the leg main body 1 is forced into the aperture 12 of the support plate 11, whereby the support plate 11 is loosely fitted around the constricted neck 3 of the leg main body 1 pivotably and rotatably. The button main body 33 to be fastened by the button leg of this invention is formed, in its rear surface, with a shallow circular recess 31 of a large diameter for receiving the support plate 11 and with a deep circular recess 32 of a small diameter which is concentric with the recess 31. The deep recess 32 is large enough to accommodate the head 2 of the leg main body 1. The support plate 11 is fitted in the circular recess 31 of the main body 33 and is adhered to the recessed portion with an adhesive 41. Consequently the head 2 of the leg main body 1 is placed in the circular recess 32 of the button main body 33 with an ample clearance, permitting the button main body 33 to be pivotably rotatably supported by the leg main body 1 by means of the support plate 11. Subsequently at a specified position of a fabric 51 to fasten the button, the shank 24 of the screw 21 is pierced through the fabric from its rear surface, and the shank thus projected from the front surface of the fabric is screwed into the bore 5 of the leg main body 1, whereby the button can be detachably fastened to the fabric, with the fabric clamped by the bottom of the main body and the upper surface of the head 23 of the screw 21.

According to the embodiment described, the objects of this invention can be fulfilled reliably for the reasons already stated. With various advantages, the invention renders buttons more valuable to use.

Figure 6:
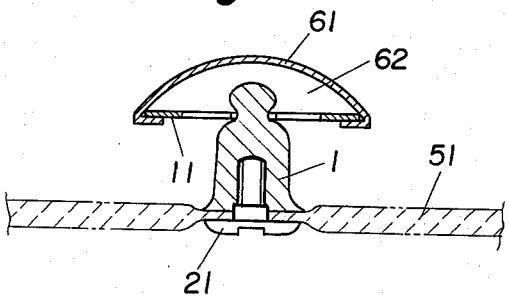
FIG. 6 is a view partly in vertical section showing the button leg during use to support another type of button main body.

Another type of button main body may be mounted on the button leg of this invention as illustrated in FIG. 6. A button main body 61 shown is shaped in the form of circular arc in section by blanking a metal plate to provide an interior space 62 for accommodating the head 2 of the button leg 1 with ample room. To fix the support plate 11 to the main body 61, the plate is placed in the interior space 62, and the peripheral edge of the main body 61 is bent inward and caulked. The button thus assembled has the same advantages as those already stated.

The present invention is not limited to the basic embodiment given above for illustrative purposes only. Various alterations and modifications which may be made by one skilled in the art are to be construed as being included within the scope of this invention insofar as they do not depart from the appended claims.

What is claimed is:

1. A button assembly with a rotatable and pivotable button, comprising a button leg body having a base end for bearing against a fabric and having an oppositely disposed outer end, a screw-threaded bore formed coaxially in said leg body and opening into the base end thereof, a screw member having a head and a screw-threaded portion for passing through a fabric and screwing into said bore such that a fabric can be tightly embraced between said base end and said screw head to detachably fasten said leg body to a fabric with the leg body standing proud from the plane of the fabric, the outer end portion of said leg body being formed with a relatively constricted neck between a relatively outwardly located head portion and a relatively inwardly located shoulder portion, said shoulder portion being proximate said head portion, the diameters of the head portion and shoulder portion being larger than the diameter of said constricted neck, and the surfaces of said shoulder portion and said head portion adjacent said constricted neck being angled away from said constricted neck to facilitate free pivotal movement of said button body, a button body having a hollow portion on one face thereof and a support plate mounted on said one face, said support plate having an aperture aligned with said hollow portion and surrounding said constricted neck of said leg body such that the portion of said support plate relatively adjacent said aperture is supported by said shoulder portion of said leg body and the head portion of said leg body is disposed with substantial clearance in said hollow portion of said button body, the diameter of said support plate aperture being smaller than the diameters of said head and shoulder portions but larger than the diameter of said constricted neck such that said button body is coupled to said leg body but is free to rotate about the longitudinal axis of said leg body and pivot about pivot axis coincident with any diametric cord passing through said constricted neck normally to said longitudinal axis of said leg body, said leg body being of elongate configuration such that said constricted neck and shoulder portion and the support plate mounted thereon are substantially removed from said base end to ensure substantial clearance for said pivotal movement of said button body even when the assembly is mounted on a fabric, said support plate being formed with at least one cut extending from the periphery of said aperture to render the aperture enlargeable and to thereby permit said head portion to be forced therethrough in either direction, whereby said button body is readily attachable to and detachable from said leg body, and said button body is free to rotate and pivot through substantial angles to facilitate buttoning and unbottoning in cooperation with a button hole.

2. A button assembly as claimed in claim 1 wherein said button body is of larger diameter than said leg body such that said button body extends out from and overhangs said leg body, the overhanging portion being unobstructed so as to permit free pivotal movement of said button body.

* * * * *